United States Patent [19]

Yacono

[11] 3,985,089

[45] Oct. 12, 1976

[54] COMBINATION FRIEZÉ AND SAXONY CARPET

[75] Inventor: Anthony J. Yacono, New Holland, Pa.

[73] Assignee: Armstrong Cork Company, Lancaster, Pa.

[22] Filed: June 23, 1972

[21] Appl. No.: 265,733

[52] U.S. Cl. ..... 112/266; 57/140 J; 57/156

[51] Int. Cl.[2] ..... D05C 15/34

[58] Field of Search ..... 112/410, 266; 57/91, 57/139 R, 140 R

[56] References Cited

UNITED STATES PATENTS 2,876,616 3/1959 Austin, Jr. et al. ..... 57/139 X

*Primary Examiner*—Werner H. Schroeder

[57] ABSTRACT

The method herein is used to achieve the combination friezé and saxony visual with the use of one yarn. Conventional slub yarns are plied and twisted with a high twist. The large diameter portions of the yarn force additional twist into the small diameter portions causing them to be greatly twisted. The large diameter sections remain relatively straight. The yarn character is set, and then this is tufted into a carpet backing. This provides a combination friezé and saxony effect in the finished product.

1 Claim, 3 Drawing Figures

Fig. I
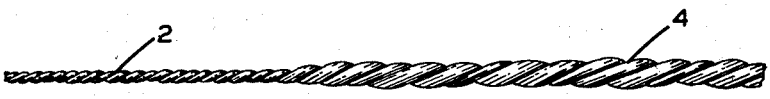
Fig. II
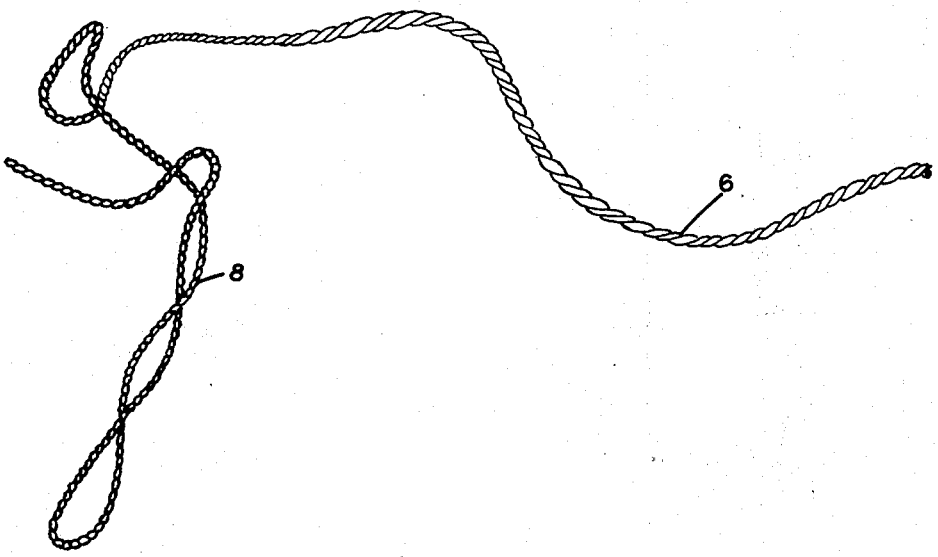
Fig. III
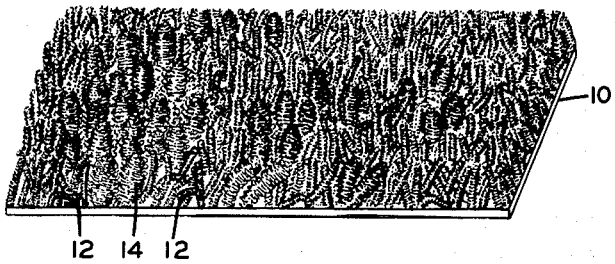

COMBINATION FRIEZE AND SAXONY CARPET

BACKGROUND OF THE INVENTION

1. Field of the Invention

The invention herein is related to a method of making and the carpet product made thereby. More particularly, it is drawn to a carpet product with a combination visual effect resulting from the use of a single yarn.

2. Description of the Prior Art

Conventional slub yarns are old in the art. These are yarns which have been plied and twisted together so as to provide in a single yarn portions of a large diameter and portions of a smaller diameter. The smaller diameter portions are secured due to the fact that in those regions the yarn strands are smaller in diameter and yarn weight. In the large diameter portions, the yarn strands are large in diameter and yarn weight, and thus a large diameter is established.

It is conventional in the art to take a single yarn which has been formed by twisting together two previously twisted strands and then subject the yarn to additional twisting as it is indicated in U.S. Pat. No. 2,445,751. Naturally, the prior art teaches the use of many twisting operations in yarns.

To date, the prior art has been making carpets with either a friezé effect or a saxony effect. The friezé effect results from the use of tightly twisted together yarns which are tufted within a carpet, and the individual loops are tightly twisted together and curled or hooked due to the characteristic twist of the yarn. This provides a carpet product which appears to have a large number of small curled twisted tufts. A saxony effect is also being provided in carpeting. Here a loosely twisted or balance twist yarn is used and is tufted into the carpet backing. The yarns are not as tightly twisted together, and the individual strands of material are relatively loose and provide straight individual tufts. It is not normal in the art to combine together a friezé yarn and a saxony yarn in a single tufting machine to form a single carpet. The factors that lead against this are that to date such an approach would require two yarns and special creeling to secure the desired effect.

Herein is provided a method which will permit the use of a single yarn to provide a combination friezé and saxony visual in a carpet. The carpet is tufted in the conventional manner with the use of a single yarn, but the carpet will end up with the combination friezé and saxony visual.

SUMMARY OF THE INVENTION

A combination friezé and saxony visual effect is secured by specially treating the conventional slub yarn. A conventional slub yarn is normally made of plural strands which are twisted together in certain areas and less strands twisted together in other areas. This provides a yarn which has relatively large diameter areas and relatively narrow diameter areas. This yarn is then plied and subjected to further twisting with a very high twist. The large diameter portions of the now-twisted slub yarn force the additional twist from those areas into the small diameter portions causing them to be even more greatly twisted. As a result of the additional twisting and the transfer of the twist from the large diameter areas to the smaller diameter areas, the large diameter areas lay relatively straight, such as you would normally expect a conventional slub yarn to so do.

However, the smaller diameter areas, having received substantially increased twisting, no longer stay in an untwisted yarn state, but the yarn is now twisted about itself and is placed in a very highly twisted state. After the twist has been set in the yarn, the yarn is then tufted into a carpet backing. The large diameter sections, being relatively untwisted, yield a saxony visual effect in the finished carpet. However, the smaller diameter sections, being very tightly twisted, will appear as very tightly twisted curled tufts in the finished product, and this will yield a friezé effect in the finished carpet. Therefore, by the special treating of a conventional slub yarn, a combination friezé and saxony visual effect can be secured in a carpet through the use of a single tufting yarn.

BRIEF DESCRIPTION OF THE DRAWING

FIG. I is a view of a conventional slub yarn;

FIG. II is a showing of how the yarn of FIG. I appears after it has received an additional high twist; and FIG. III is a perspective view of a carpet which has been made by tufting the yarn of FIG. II into a carpet backing.

DESCRIPTION OF THE PREFERRED EMBODIMENT

In FIG. I, there is shown a conventional slub yarn. This yarn is normally made as a rather conventional yarn by twisting together two or more strands. One portion of a yarn strand is about 2000 denier, and another portion is about 3500 denier. When several strands are twisted together with about 3.5 twists per inch, the finished product appears in some areas as a tightly twisted small diameter yarn, very similar to that of section 2 of FIG. I, or as a large diameter yarn with the appearance of that of section 4 of FIG. I. The yarn strands of the larger denier are in the yarn of section 4 and it will be substantially greater in diameter than that of the twisted section 2 with the smaller denier strands. Such slub yarns are conventional in the art and readily available from a number of manufacturers.

The conventional slub yarn is then subjected to an additional high twist in a conventional manner. In the textile art, it is conventional to twist yarn, and a number of different apparatuses and methods are available for twisting yarn. When a conventional slub yarn is subjected to an additional twist of about 3.5 twists per inch, it is then converted from the appearance of FIG. I to that of FIG. II. The large diameter section 4 will still appear as a relatively large diameter section 6 with a slight additional twist and a tendency to lay not in a perfectly flat condition, but with a slight curve. However, the now highly twisted smaller diameter section 8 will be greatly twisted about itself. The additional twist which is put in the large diameter portions of the yarn is forced by the yarn itself into the small diameter portions causing them to twist even more than would be expected from the additional twisting of the conventional slub yarn. Consequently, the strand of yarn which forms the section 8 is not only now tightly twisted itself, but it also as a whole twists about itself.

After the conventional slub yarn receives the additional high twist, it is skeined, steam tumbled, stretched and autoclaved, such as is normally done in the art to set the yarn character. The yarn is placed on textile cones and from these it will be fed into a conventional tufting machine. The yarn of FIG. II is conventionally tufted into a carpet backing to form a tufted carpet.

The resultant carpet takes on the appearance of the carpet as shown in FIG. III. The carpet backing 10 has tufted into it the yarn of FIG. II, and a friezé and saxony visual is provided in the finished product. The tufts 12 are formed from the small diameter sections 8 of the yarn of FIG. II. These will appear in the finished product as tightly twisted together curled tufts, which will yield the friezé effect. The large diameter sections 6 of the yarn of FIG. II will provide tufts 14 which may be somewhat larger in size than the tufts 12 and are formed from yarns which are straight and not tightly twisted together. This then provides the saxony effect. Consequently, a single yarn is being used to provide one with two separate visual effects in the carpet. Normally, such visual effects could only be secured by the use of two separate yarns which would require special creeling during the tufting operation.

There is no criticality in the particular yarn material used, and nylon and acrylic yarns are particularly useful for forming the carpet of FIG. III. The carpet backing is conventional in the art and may simply be a burlap backing. All processing operations are carried out on conventional machinery.

What is claimed is:

1. The method of forming a carpet with a combination friezé and saxony visual effect, comprising the steps of, forming a conventional slub yarn which has sections of the yarn with a large diameter relative to other sections of the yarn which are of a relatively small diameter, said diameter relationship being established by the difference in the diameters and yarn weight of the individual sections which form the slub yarn, additionally twisting the slub yarn to a very high twist to place additional twist into the slub yarn, permitting the additional twist in the large diameter sections of the slub yarn to be transmitted by the yarn to the small diameter sections of the slub yarn so that the large diameter sections of the slub yarn are relatively free of the additional twisting and the small diameter sections of the conventional slub yarn are greatly twisted and the yarn as a whole tends to twist about itself, setting the twist within the yarn, and then tufting the yarn into a carpet backing to form tufts which are either tightly twisted together and curled, or relatively loosely twisted together and straight, said highly twisted sections of the conventional slub yarn forming the tightly twisted and curled tufts, whereas the relatively untwisted sections of the conventional slub yarn form the lightly twisted and straight tufts whereby the tightly twisted and curled tufts provide a friezé visual effect and the relatively untwisted straight tufts provide a saxony visual effect.

* * * * *